US009822798B2

(12) United States Patent
Yoshida et al.

(10) Patent No.: US 9,822,798 B2
(45) Date of Patent: Nov. 21, 2017

(54) BUNDLE GUIDING DEVICE OF COMPRESSOR AND BUNDLE GUIDING METHOD OF COMPRESSOR

(71) Applicant: MITSUBISHI HEAVY INDUSTRIES COMPRESSOR CORPORATION, Tokyo (JP)

(72) Inventors: Satoru Yoshida, Hiroshima (JP); Toru Yoshimune, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 385 days.

(21) Appl. No.: 14/378,137

(22) PCT Filed: Feb. 19, 2013

(86) PCT No.: PCT/JP2013/053964
§ 371 (c)(1),
(2) Date: Aug. 12, 2014

(87) PCT Pub. No.: WO2013/125512
PCT Pub. Date: Aug. 29, 2013

(65) Prior Publication Data

US 2015/0007435 A1 Jan. 8, 2015

(30) Foreign Application Priority Data

Feb. 24, 2012 (JP) ..... 2012-038601

(51) Int. Cl.
*F04D 29/60* (2006.01)
*F04D 29/64* (2006.01)
(Continued)

(52) U.S. Cl.
CPC ..... *F04D 29/60* (2013.01); *F04D 17/125* (2013.01); *F04D 19/02* (2013.01); *F04D 29/624* (2013.01);
(Continued)

(58) Field of Classification Search
CPC ..... F04D 29/60; F04D 29/64; F04D 29/642; F04D 29/644; F04D 29/624; F01D 25/28;
(Continued)

(56) References Cited

U.S. PATENT DOCUMENTS 3,584,967 A * 6/1971 Zerlauth ..... F01D 25/246 415/137
4,113,089 A * 9/1978 Bush ..... F04D 1/063 206/319
(Continued)

FOREIGN PATENT DOCUMENTS

CN 102121478 7/2011
CN 102235373 11/2011
(Continued)

OTHER PUBLICATIONS

International Search Report dated May 21, 2013 in corresponding International Application No. PCT/JP2013/053964.
(Continued)

*Primary Examiner* — Jason L Vaughan
*Assistant Examiner* — Amanda Meneghini
(74) *Attorney, Agent, or Firm* — Wenderoth, Lind & Ponack, L.L.P.

(57) ABSTRACT

A bundle guiding device includes an inner roller mounted on a front portion of a bundle in an insertion direction where the bundle is to be inserted into a casing and configured to roll on an inner peripheral surface of the casing, an outer roller mounted on a rear portion of the bundle in the insertion direction where the bundle is to be inserted into the casing
(Continued)

and configured to travel on a rail member, and a position adjusting mechanism configured to adjust a position of the bundle in a horizontal direction orthogonal to the insertion direction by applying an adjusting force to a receiving portion, one of the position adjusting mechanism and the receiving portion being on the bundle, and the other of the position adjusting mechanism and the receiving portion being on one of a base surface and the rail member.

10 Claims, 7 Drawing Sheets

(51) Int. Cl.
*F04D 19/02* (2006.01)
*F04D 29/62* (2006.01)
*F04D 17/12* (2006.01)
*F01D 25/28* (2006.01)

(52) U.S. Cl.
CPC ..... *F04D 29/644* (2013.01); *F01D 25/28* (2013.01); *Y10T 29/49236* (2015.01); *Y10T 29/53657* (2015.01)

(58) Field of Classification Search
CPC ..... F01D 25/285; Y10T 29/49236; Y10T 29/49238; Y10T 29/49245; Y10T 29/49318; Y10T 29/4932; Y10T 29/49323; Y10T 29/49327; Y10T 29/53435; Y10T 29/53961; Y10T 59/53974; B23P 6/002; B23P 6/005; B23P 6/007; B23P 19/10; B23P 19/12; B23P 19/04; B23P 19/042; F05D 2230/60; F05D 2230/64; F05D 2230/68; F05D 2230/70; F05D 2230/72; F05D 2230/80
See application file for complete search history.

(56) References Cited

U.S. PATENT DOCUMENTS

| | | | | |
|---|---|---|---|---|
| 5,971,702 | A * | 10/1999 | Afton | B23P 19/022 29/888.011 |
| 6,279,309 | B1 * | 8/2001 | Lawlor | F02K 7/10 60/39.35 |
| 8,534,986 | B2 * | 9/2013 | Borer | F04D 29/624 29/281.1 |
| 8,590,151 | B2 * | 11/2013 | Brown | F01D 25/285 184/1.5 |
| 8,677,589 | B2 * | 3/2014 | Ziekow | B23P 19/022 29/281.1 |
| 8,974,176 | B2 * | 3/2015 | Sasaki | F04D 17/122 415/199.2 |
| 2009/0288291 | A1 | 11/2009 | Ziekow et al. | |
| 2011/0052426 | A1 | 3/2011 | Borer et al. | |

FOREIGN PATENT DOCUMENTS

| | | |
|---|---|---|
| JP | 2000-38988 | 2/2000 |
| JP | 2009-513863 | 4/2009 |
| JP | 2011-220307 | 11/2011 |
| JP | 2012-177331 | 9/2012 |
| JP | 2012-177337 | 9/2012 |

OTHER PUBLICATIONS

Translation of Written Opinion of the International Searching Authority dated May 21, 2013 in corresponding International Application No. PCT/JP2013/053964.
Extended European Search Report dated Sep. 21, 2015 in corresponding European Application No. 13751408.9.
Office Action dated Oct. 8, 2015 in corresponding Chinese Application No. 201380007497.3 (with partial English translation).
Notice of Reasons for Rejection dated May 26, 2015 in corresponding Japanese Application No. 2014-500711 (with English translation).

* cited by examiner

BUNDLE GUIDING DEVICE OF COMPRESSOR AND BUNDLE GUIDING METHOD OF COMPRESSOR

TECHNICAL FIELD

The present invention relates to a bundle guiding device of a compressor and a bundle guiding method of a compressor configured to guide a bundle into a casing.

Priority is claimed from Japanese Patent Application No. 2012-038601, filed Feb. 24, 2012, the content of which is incorporated herein by reference.

BACKGROUND ART

A vertically divided compressor is known in which a substantially columnar bundle in which a rotor, a vane, or the like is received is allowed to be inserted into or separated from a substantially cylindrical casing in an axial direction. The vertically divided compressor is provided with a pair of inner rollers provided at a front lower end portion of the bundle and a carriage that supports a rear portion of the bundle, in order to prevent the bundle from interfering with an inner peripheral surface of the casing when the bundle is inserted into the casing. Further, the inclination angle of the bundle is corrected so that a relative angular difference between the bundle and the casing becomes a predetermined angular difference, while the bundle is inserted into the casing (for example, see Japanese Unexamined Patent Application, First Publication No. 2011-220307).

Problem to be Solved by the Invention

However, according to the above-mentioned bundle guiding device, when an angular difference is generated between the casing and the bundle in a width direction, a worker should correct a track of the bundle using a jack or the like while moving the bundle in an insertion direction. Accordingly, since time is required for the bundle to be completely received in the casing, there is a problem in that the burden of a worker is increased.

SUMMARY OF INVENTION

The invention provides a bundle guiding device of a compressor and a bundle guiding method of a compressor that can reduce the burden of a worker by reducing the time required to perform work which allows a bundle to be received in a casing.

Means for Solving the Problem

The following structure is employed to solve the above-mentioned problem.

A bundle guiding device of a compressor according to an embodiment of the invention is provided in which a bundle is inserted to a substantially cylindrical casing, and the bundle includes a rotor and a stationary part by which the rotor is rotatably supported. The bundle guiding device includes an inner roller that is mounted on a front portion of the bundle in an insertion direction of the bundle and is configured to roll in the insertion direction on an inner peripheral surface of the casing, an outer roller that is mounted on a rear portion of the bundle in the insertion direction of the bundle and is configured to travel on a rail member fixed onto a base surface on which the casing is disposed, a receiving portion that is provided on one of the base surface and the rail member and the bundle; and a position adjusting mechanism that is provided on another of the base surface and the rail member and the bundle, and is configured to adjust the position of the bundle in a horizontal direction orthogonal to the insertion direction by applying an adjusting force to the receiving portion in the horizontal direction.

According to this structure, an adjusting force is applied to the receiving portion in the horizontal direction, which is orthogonal to the insertion direction of the bundle, by the position adjusting mechanism. Accordingly, it is possible to displace the bundle in the horizontal direction orthogonal to the insertion direction. For this reason, it is possible to correct an angular difference that is generated between the axis of the bundle and the axis of the casing in plan view.

Further, in the bundle guiding device of a compressor according to the embodiment of the invention, the position adjusting mechanism may include a metal roller configured to roll in the insertion direction while in contact with the receiving portion.

According to this structure, it is possible to smoothly move the bundle in the insertion direction by reducing frictional resistance between the position adjusting mechanism and the receiving portion when inserting the bundle into the casing. Furthermore, since a metal roller is used, it is possible to suppress elastic deformation or the like as compared to a case in which a roller made of a resin, for example, is used. Accordingly, it is possible to more accurately adjust the position of the bundle in the horizontal direction.

In addition, a bundle guiding method of a compressor according to another embodiment of the invention is provided in which a bundle is inserted to a substantially cylindrical casing, and the bundle includes a rotor and a stationary part by which the rotor is rotatably supported. The bundle guiding method includes: moving the bundle into the casing from a rail member while an adjusting force is not applied to a receiving portion, which is provided on one of a base surface on which the casing is disposed or the rail member fixed to the base surface and the bundle, from a position adjusting mechanism that is provided on another thereof; and adjusting the position of the bundle in a horizontal direction orthogonal to an insertion direction by applying an adjusting force to the receiving portion from the position adjusting mechanism in the horizontal direction while the movement of the bundle is stopped.

According to this method, work which adjusts the position of the bundle in the horizontal direction is performed during stoppage of the bundle. Accordingly, an adjusting force is not applied to the receiving portion from the position adjusting mechanism during movement of the bundle. Accordingly, the bundle can be accurately and smoothly moved without being affected by a dimension error or a mounting error of the rail member or the like and a frictional force between the position adjusting mechanism and the rail member.

Effects of the Invention

According to the bundle guiding device of a compressor of the invention, it is possible to reduce the burden of a worker by reducing the time required to perform work which allows a bundle to be received in a casing.

DESCRIPTION OF EMBODIMENTS

Next, a bundle guiding device 100 for a compressor of a first embodiment of the invention will be described with reference to the drawings.

Figure 1:
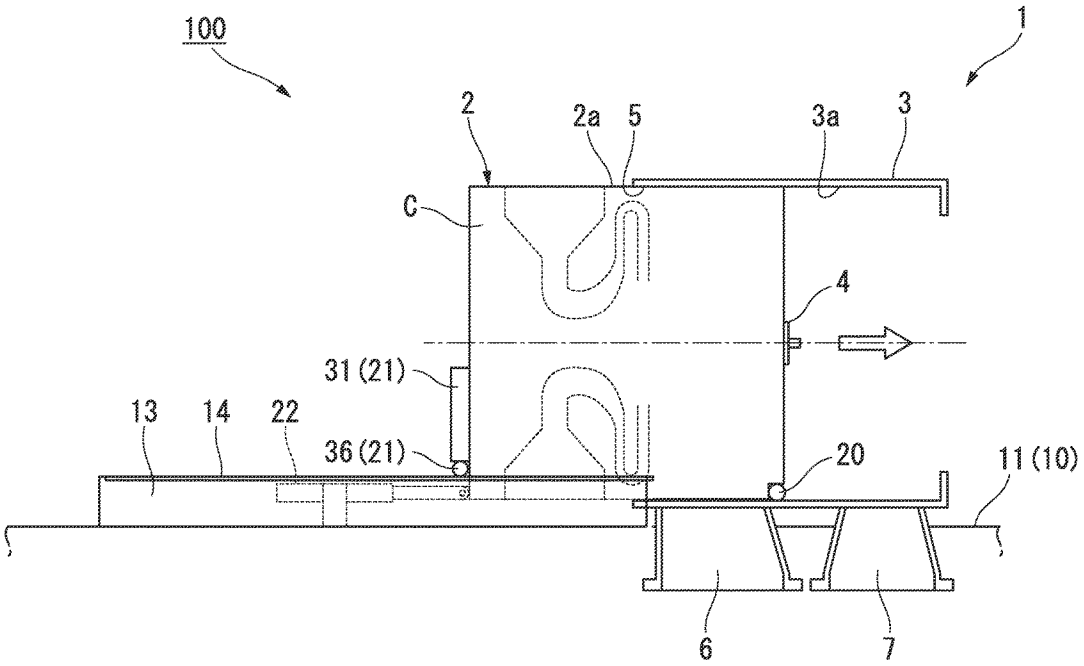
FIG. 1 is a view showing the schematic structure of a compressor of an embodiment of the invention.

FIG. 1 is a view showing the schematic structure of the bundle guiding device 100 for the compressor of this embodiment.

As shown in FIG. 1, the compressor 1 is a vertically divided compressor, and mainly includes a substantially columnar bundle 2 and a substantially cylindrical casing 3. The bundle 2 includes a rotor 4 that is received in the bundle 2 and a stationary part C by which the rotor 4 is rotatably supported.

The bundle 2 can be received in the casing 3, and the diameter of an inner peripheral surface 3*a* of the casing 3 is slightly larger than the diameter of an outer peripheral surface 2*a* of the bundle 2 (for example, by about several millimeters). The casing 3 is fixed onto a horizontal base surface 11 of a frame 10 so that the axial direction of the casing 3 is parallel to the horizontal direction. An opening 5 through which the bundle 2 is inserted into or separated from the casing 3 is formed on one side of the casing 3 in the axial direction. Further, a suction nozzle 6 and a discharge nozzle 7 are mounted on the casing 3 so as to be lined up in the axial direction. Each of the suction nozzle 6 and the discharge nozzle 7 increases in diameter downwardly and opens downwardly.

Figure 2:
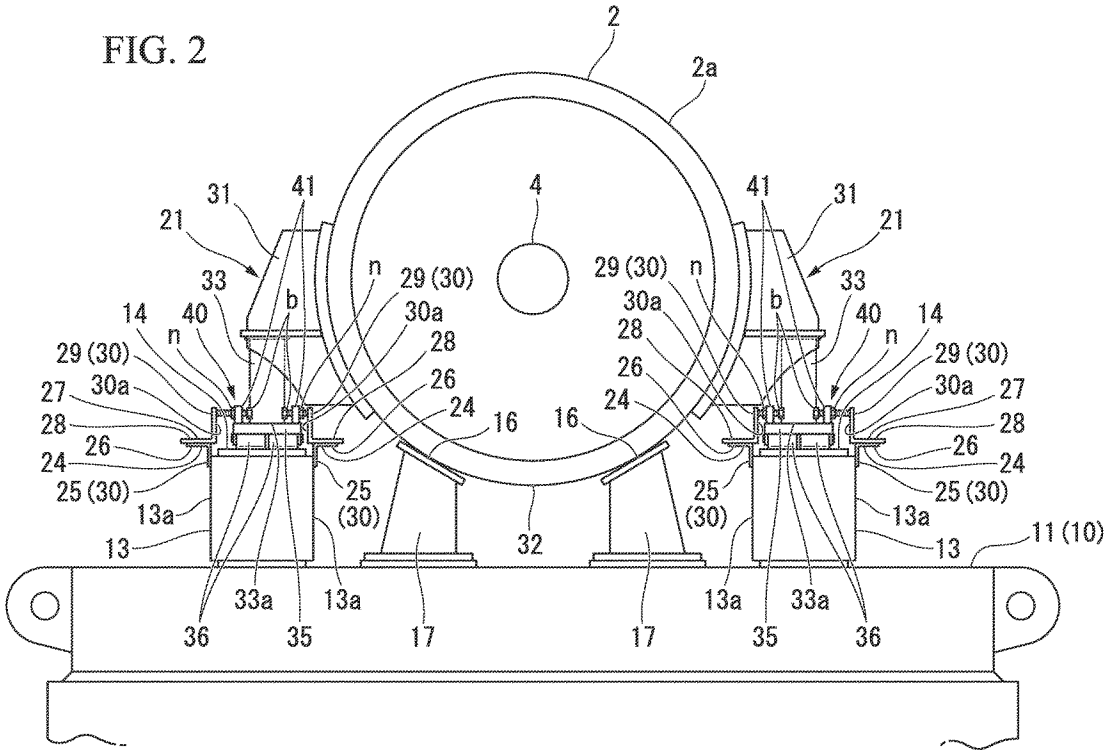
FIG. 2 is a side view of a bundle to be inserted into a compressor that is seen in an axial direction.

The frame 10 extends in the axial direction from the lower portion of the casing 3 so as to become distant from the opening 5. As shown in FIGS. 1 and 2, a pair of left and right rail members 13 extends in the axial direction on the base surface 11 of the frame 10 so as to become distant from the opening 5 of the casing 3. Upper surfaces 14 of the pair of rail members 13 are horizontal surfaces, and the rail members 13 are disposed parallel to each other at substantially the same interval as the diameter of the bundle 2. Furthermore, a pair of inner rail members 17, which includes inclined surfaces 16 facing the outer peripheral surface 2*a* of the bundle 2, extends inside a track of the pair of rail members 13.

Inner rollers 20, which are allowed to travel along the axial direction of the bundle 2, are provided at a front portion of the bundle 2 in an insertion direction of the bundle 2, more particularly, at a front lower portion of the outer peripheral surface 2*a*. The inner rollers 20 can roll on the inner peripheral surface 3*a* of the casing 3. When the front portion of the bundle 2 is inserted into the casing 3, the rolling of the inner rollers 20 enables the front portion of the bundle 2 to be smoothly pushed into the front portion of the casing 3. When the bundle 2 is removed from the casing 3, the rolling of the inner rollers 20 enables the front portion of the bundle 2 to be smoothly drawn up to the opening 5 of the casing 3. Meanwhile, the insertion direction of the bundle 2 is shown in FIG. 1 with an arrow.

Moreover, the inner rollers 20 are allowed to travel on the inclined surfaces 16 of the above-mentioned inner rail members 17 along the inner rail members 17. The inclined surfaces 16 of the pair of inner rail members 17 are inclined toward the inside of the track of the inner rail members 17. Further, since the inclined surfaces 16 of the inner rail members 17 are flush with the inner peripheral surface 3*a* of the casing 3, the inner rollers 20 are allowed to move smoothly toward the casing 3 from the inner rail members 17. Meanwhile, the inner rollers 20 may be omitted, according to the scale of the compressor.

Rear traveling mechanisms 21, which are allowed to travel on the upper surfaces 14 of the rail members 13, are further mounted on both left and right sides of a rear end portion of the outer peripheral surface 2*a* of the bundle 2.

Further, a hydraulic cylinder 22 is mounted along the rail members 13 on the frame 10. When the bundle 2 is received in the casing 3, the bundle 2 can be pressed along the rail members 13 by the hydraulic cylinder 22. When the bundle 2 is removed from the casing 3, the bundle 2 can be drawn along the rail members 13 by the hydraulic cylinder 22.

First angle steels 24 having an L-shaped cross section are fixed to the above-mentioned pair of rail members 13 along upper sides of side surfaces 13*a* by welding or the like. A lower portion of a first flat plate portion 25 of the first angle steel 24 is fixed to an upper portion of the side surface 13*a* of the rail member 13, and a second flat plate portion 26 thereof extends outward in a width direction of the rail member 13. Furthermore, second angle steels 27, which extend along the first angle steels 24, are fixed to the second flat plate portions 26 of the first angle steels 24 by bolts or the like. A first flat plate portion 28 of the second angle steel 27 is fixed to the second flat plate portion 26 of the first angle steel 24 so as to face the other flat plate portion 26, and the second flat plate portion 29 thereof extends substantially upward in a vertical direction. Receiving portions 30, which extend upward from the side surfaces 13*a* of the rail member 13, are formed of the first flat plate portions 25 of the first angle steels 24 and the second flat plate portions 29 of the second angle steels.

Brackets 31, which extend outward in a width direction of the bundle 2, are mounted on the outer peripheral surface 2*a* of the rear side (hereinafter, simply referred to as a rear portion) of the bundle 2 in the insertion direction of the bundle 2 by fastening members (not shown) such as bolts. Support posts 33, which extend downward to a position slightly above a lower end portion 32 of the bundle 2 in the vertical direction, are mounted on the brackets 31. Further, a substantially plate-like support portion 35, which is formed so as to have a width smaller than the width of the rail member 13, is mounted on a lower end portion 33*a* of each of the support posts 33.

Two substantially columnar outer rollers 36 of which rotation axes are substantially parallel to the width direction of the rail member 13 are supported by each support portion 35 so as to freely rotate while being lined up in the width direction of the rail member 13.

That is, the outer rollers 36 are allowed to roll on the upper surface 14 of the above-mentioned rail member 13 in an extending direction of the rail member 13. The above-mentioned rear traveling mechanism 21 includes the bracket 31, the support post 33, the support portion 35, and the outer rollers 36, which have been mentioned above, as main components. That is, the rear portion of the bundle 2 is supported on the rail members 13 through the rear traveling mechanisms 21.

The rear traveling mechanism 21 further includes a position adjusting mechanism 40 that applies adjusting forces to the receiving portions 30 in the horizontal direction orthogonal to the insertion direction of the bundle 2. The position adjusting mechanism 40 adjusts the position of the rear traveling mechanism 21, more specifically, the position of the rear traveling mechanism 21 in the horizontal direction orthogonal to the insertion direction of the bundle 2. The position adjusting mechanisms 40 are separately provided on both sides of the upper surfaces of the support portions 35 of the rear traveling mechanisms 21 in the horizontal direction.

Each of the position adjusting mechanisms 40 includes nut support portions 41 that protrude upward in the vertical direction from both side portions of the support portion 35 in the horizontal direction, respectively. Nuts n are fixed to the nut support portions 41 so that screw holes are directed to the horizontal direction. Moreover, the position adjusting mechanism 40 includes bolts b which are threadedly engaged with the screw holes of the nuts n and of which end portions protrude toward the receiving portions 30.

The bolts b are threadedly engaged with the nuts n so that the end portions of the bolts come into contact with inner side surfaces 30*a* of the receiving portions 30. That is, since the end portions of the bolts b extend toward both outer sides of the rail member 13 in the width direction and come into contact with the receiving portions 30, the displacement of the rear traveling mechanism 21 in the horizontal direction is regulated.

Meanwhile, the nut n and the bolt b, which have been mentioned above, may be a so-called ball screw structure.

Further, in the position adjusting mechanism 40, the lengths of portions of the bolts b protruding from the nuts n in the horizontal direction are allowed to be adjusted by the rotation of the bolts b, thereby the inner side surfaces 30*a* of the receiving portions 30 are allowed to be pressed by the end portions of the bolts b. When the left and right bolts b of the position adjusting mechanism 40 are rotated in a normal direction, the lengths of portions of the bolts b protruding from the nuts n toward the receiving portions 30 are increased. Meanwhile, when the bolts b are rotated in a reverse direction, the lengths of portions of the bolts b protruding from the nuts n toward the receiving portions 30 are reduced.

That is, it is possible to change the horizontal position of the rear traveling mechanism 21 relative to the rail member 13 by increasing the length of the protruding portion of one bolt b of the left and right bolts b, which are mounted on one rear traveling mechanism 21, and reducing the length of the protruding portion of the other bolt b thereof. More specifically, when the receiving portion 30 is pressed in the horizontal direction by the end portion of one bolt b, the rear traveling mechanism 21 is displaced in the horizontal direction on the rail member 13 by the reaction of this pressing force. Further, it is possible to displace the rear portion of the bundle 2 in the horizontal direction, which is orthogonal to the insertion direction of the bundle 2, by adjusting the lengths of the protruding portions of the respective bolts b in the left and right rear traveling mechanisms 21.

Figure 3:
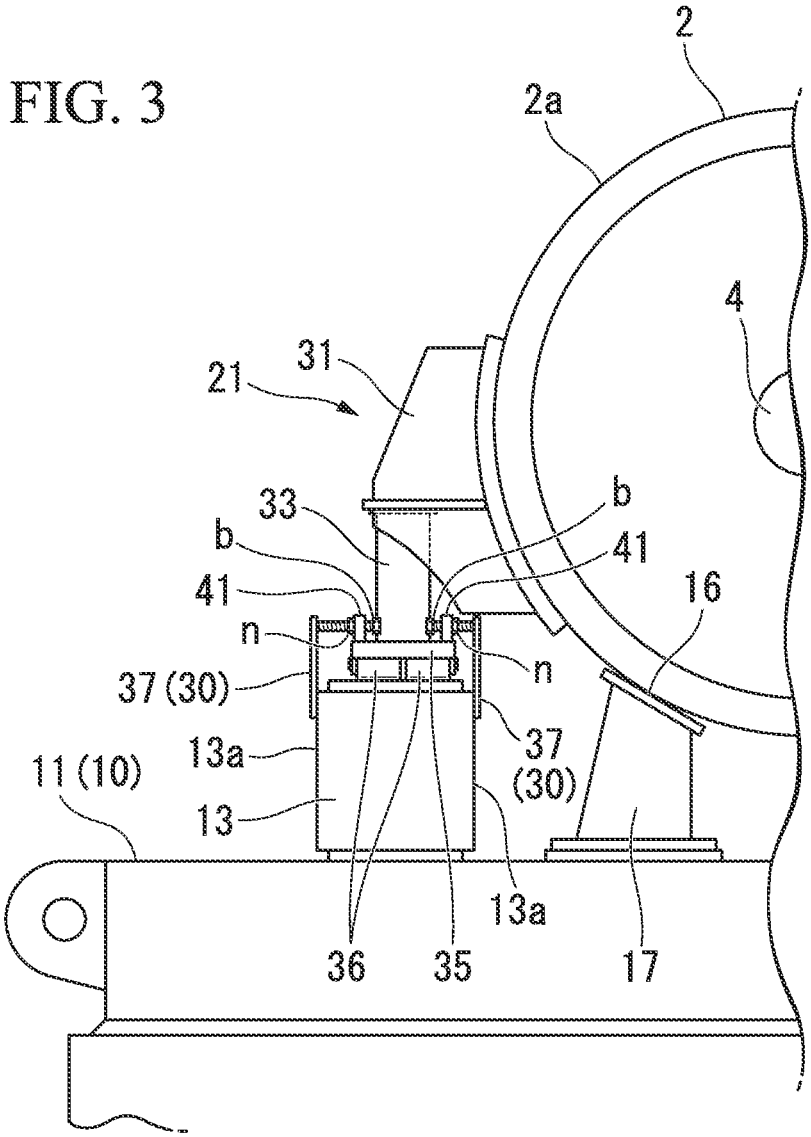
FIG. 3 is a side view of a bundle in a modification of the embodiment that is seen in an axial direction.

Meanwhile, a case in which the receiving portion 30 is formed of the angle steels has been described in the above-mentioned first embodiment. However, in order to form the receiving portion 30, a flat steel 37 may be provided so as to extend upward from the side surface 13*a* of the rail member 13 as in a modification shown in FIG. 3. For convenience of explanation, the receiving portions 30 are not shown in FIG. 1.

Next, a procedure for inserting the above-mentioned bundle 2 into the casing 3 will be described.

First, the rear end portion of the bundle 2 is placed on the rail members 13 through the rear traveling mechanisms 21. Further, at this time, the inner rollers 20, which are provided at the front portion of the bundle 2, are placed on the inner rail members 17.

After that, the bundle 2 is pressed toward the casing 3 by the hydraulic cylinder 22. Accordingly, the inner rollers 20 move on the inner peripheral surface 3*a* of the casing 3 by rolling on the inner rail members 17. At the same time, the outer rollers 36 move in the axial direction by rolling on the rail members 13. Meanwhile, the axis of the casing 3 and the axis of the front portion of the bundle 2 substantially correspond to each other in a height direction and a width direction.

Furthermore, when the bundle 2 is pressed toward the casing 3 by the hydraulic cylinder 22, the inner rollers 20 roll in the axial direction on the inner peripheral surface 3*a* of the casing 3 and the outer rollers 36 roll on the rail members 13. Further, the bundle 2 is gradually inserted into the casing 3 by the rolling of the inner rollers 20 and the outer rollers 36.

Here, when an angular difference is generated between the axis of the bundle 2 and the axis of the casing 3 in plan view while the bundle 2 is inserted into the casing 3, horizontal adjusting forces are applied to the receiving portions 30 by the rotation of the bolts b of the position adjusting mechanisms 40 in order to adjust the positions of the outer rollers 36 in the width direction of the rail member 13. Accordingly, the bundle 2 is inserted into the casing 3 while the axis of the bundle 2 overlaps with the axis of the casing 3. Further, when the bundle 2 has been completely received in the casing 3, the rear traveling mechanisms 21 are removed from the bundle 2 and a series of the above-mentioned work for inserting the bundle 2 into the casing 3 ends. Meanwhile, since work for removing the bundle 2 from the casing 3 may be performed in a reverse procedure of the above-mentioned work for inserting the bundle, the details of the work for removing the bundle will be omitted here.

According to the bundle guiding device of the above-mentioned first embodiment, it is possible to displace the bundle 2 in the horizontal direction, which is orthogonal to the insertion direction, by applying adjusting forces to the receiving portions 30 in the horizontal direction, which is orthogonal to the insertion direction of the bundle 2, with the position adjusting mechanisms 40. Therefore, it is possible to correct an angular difference in plan view that is generated between the axis of the bundle 2 and the axis of the casing 3. As a result, since it is possible to easily correct an angular difference in plan view, it is possible to reduce the time required to perform work which allows the bundle 2 to be received in the casing 3 while preventing the outer peripheral surface 2*a* of the bundle 2 and the inner peripheral surface 3*a* of the casing 3 from coming into contact with each other. Accordingly, it is possible to reduce the burden of a worker.

Next, a bundle guiding device of a second embodiment of the invention will be described with reference to the drawings. Compared to the bundle guiding device of the above-mentioned first embodiment, the bundle guiding device of the second embodiment is different only in terms of the structure of the position adjusting mechanism 40. Accordingly, the same portions as portions of the above-mentioned first embodiment will be denoted by the same reference numerals and a repeated description thereof will be omitted here.

Figure 4:
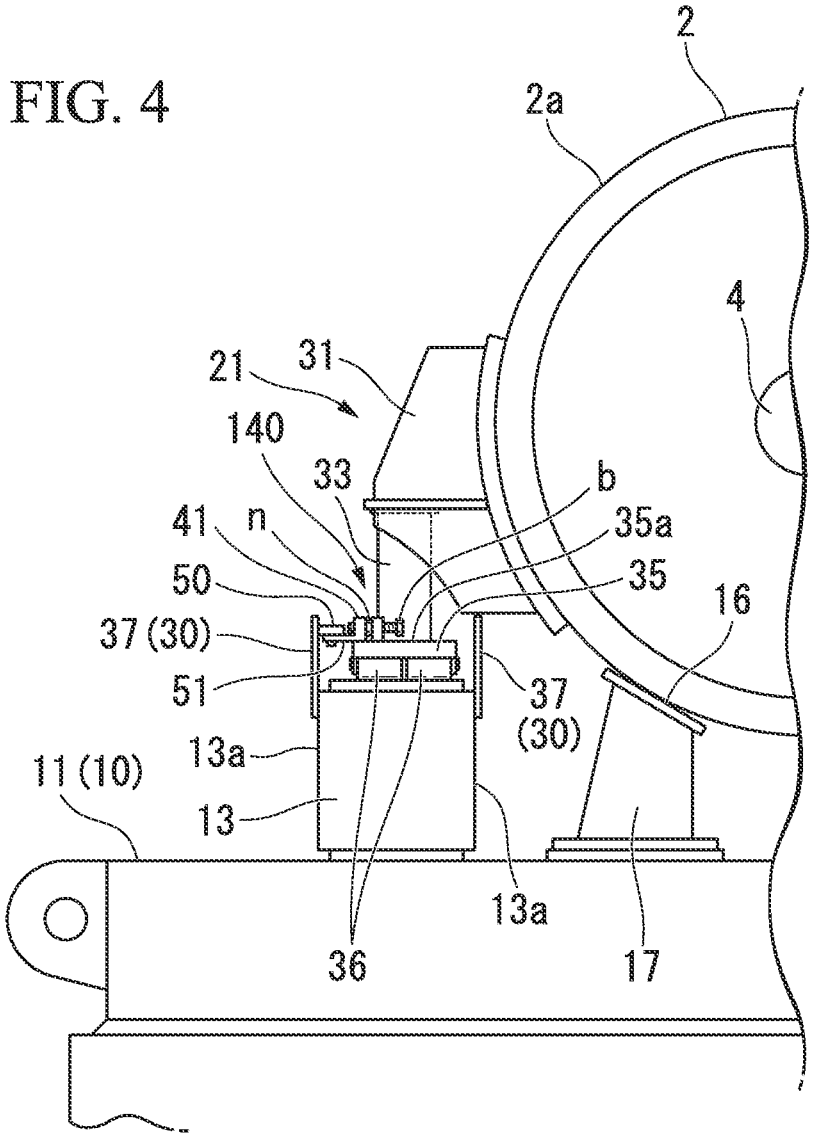
FIG. 4 is a side view of a second embodiment of the invention corresponding to FIG. 3.

As shown in FIG. 4, in the bundle guiding device 100 of this embodiment, the rear traveling mechanisms 21 are mounted on the outer peripheral surface 2*a* of the rear portion of the bundle 2 as in the above-mentioned first embodiment.

As in the above-mentioned first embodiment, the rear traveling mechanism 21 includes the bracket 31, the support post 33, the support portion 35, and the outer rollers 36. Meanwhile, since the structures of the rear traveling mechanisms 21, which are mounted on the left and right sides, are symmetrical with each other, only one rear traveling mechanism 21 will be described in the description of this embodiment (hereinafter, this is the same even in a third embodiment).

A position adjusting mechanism 140 of this embodiment is mounted on the upper surface 35*a* of the support portion 35. The position adjusting mechanism 140 includes a roller member 50 that comes into contact with the receiving portion 30. The roller member 50 is disposed so that a rotation axis of the roller member is parallel to the vertical direction. The roller member 50 is rotatably mounted on an end portion of a slide member 51 that is mounted on the support portion 35. The slide member 51 is mounted so as to be slidable relative to the support portion 35 in the width direction of the rail member 13.

The slide member 51 includes a nut support portion 41 that is formed by bending an inner portion of the slide member 51 upward in the width direction of the rail member 13, and a nut n is fixed to the nut support portion 41. A bolt b, which is rotatably mounted on the support portion 35, is threadedly engaged with the nut n. That is, the slide position of the slide member 51 is changed in the width direction of the rail member 13 by the rotation of the bolt b.

The roller members 50 of the position adjusting mechanisms 140 are disposed on the left and right outer sides of a pair of left and right rear traveling mechanisms 21, respectively. Further, the slide position of one slide member 51 of the left and right slide members 51 is changed to the outside of the track formed by the pair of rail members 13, and the slide position of the other slide member 51 is changed to the inside of the track. Accordingly, one roller member 50 presses the receiving portion 30, and the rear traveling mechanism 21 is displaced in the horizontal direction orthogonal to the axial direction, which is the insertion direction of the bundle 2, by the reaction of the pressing force of the roller member 50. Meanwhile, the respective roller members 50 are not limited to the disposition in which the roller members 50 face the left and right outer sides, and may be disposed so as to face the left and right inner sides.

According to the bundle guiding device 100 of the above-mentioned second embodiment, since the above-mentioned roller member 50 is used, it is possible to smoothly move the bundle 2 in the insertion direction by reducing frictional resistance between the position adjusting mechanism 140 and the receiving portion 30 when inserting the bundle 2 into the casing 3. Moreover, when the roller member 50 is made of metal, it is possible to suppress elastic deformation or the like as compared to a case in which a roller member made of a resin, for example, is used. Accordingly, it is possible to more accurately adjust the position of the bundle 2 in the horizontal direction.

Next, a bundle guiding device 100 of a third embodiment of the invention will be described with reference to the drawings.

Compared to the above-mentioned first embodiment, the bundle guiding device 100 of the third embodiment is different in terms of the structure of a rear traveling mechanism 21 and a position adjusting mechanism 240. Accordingly, the same portions as portions of the above-mentioned first embodiment will be denoted by the same reference numerals and a repeated description thereof will be omitted here.

Figure 5:
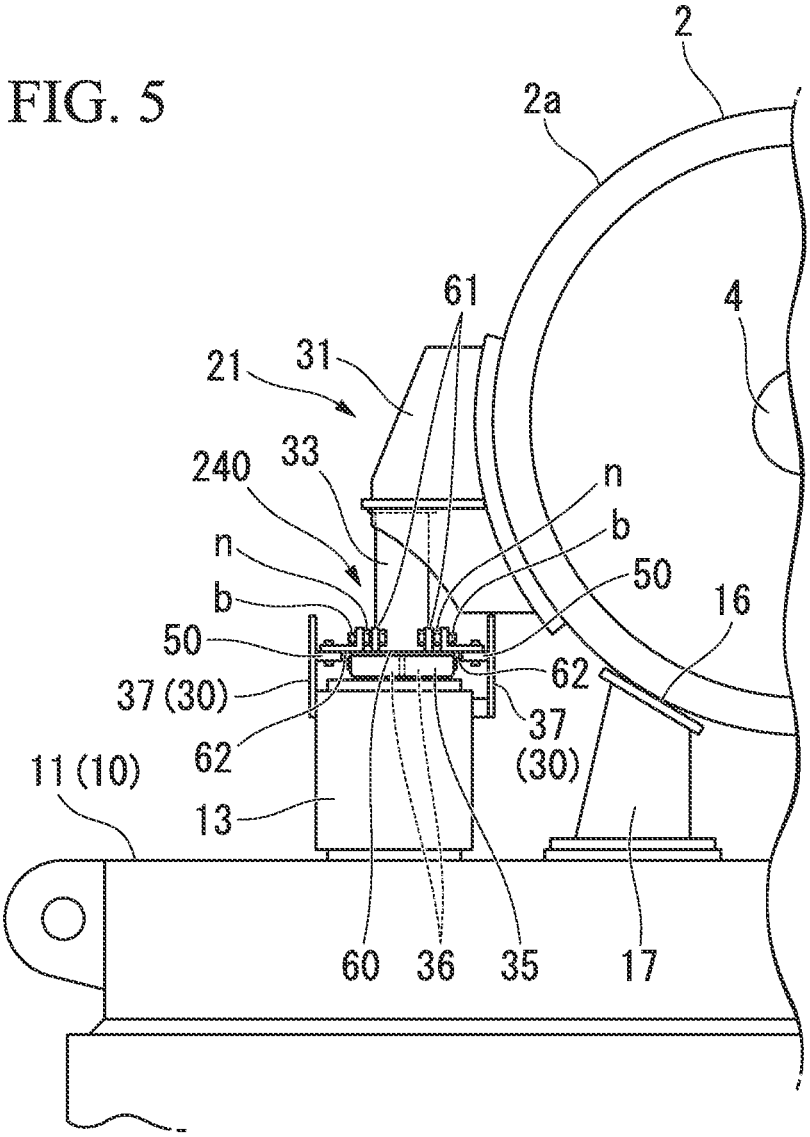
FIG. 5 is a side view of a third embodiment of the invention corresponding to FIG. 3.

As shown in FIG. 5, in the bundle guiding device 100 of this embodiment, the rear traveling mechanisms 21 are mounted on the outer peripheral surface 2*a* of the rear portion of the bundle 2 as in the above-mentioned first embodiment. As in the above-mentioned first embodiment, the rear traveling mechanism 21 includes the bracket 31, the support post 33, the support portion 35, and the outer rollers 36. Meanwhile, in one example of this third embodiment, the support portion 35 is provided so as to cover the upper portions of the outer rollers 36.

Figure 6:
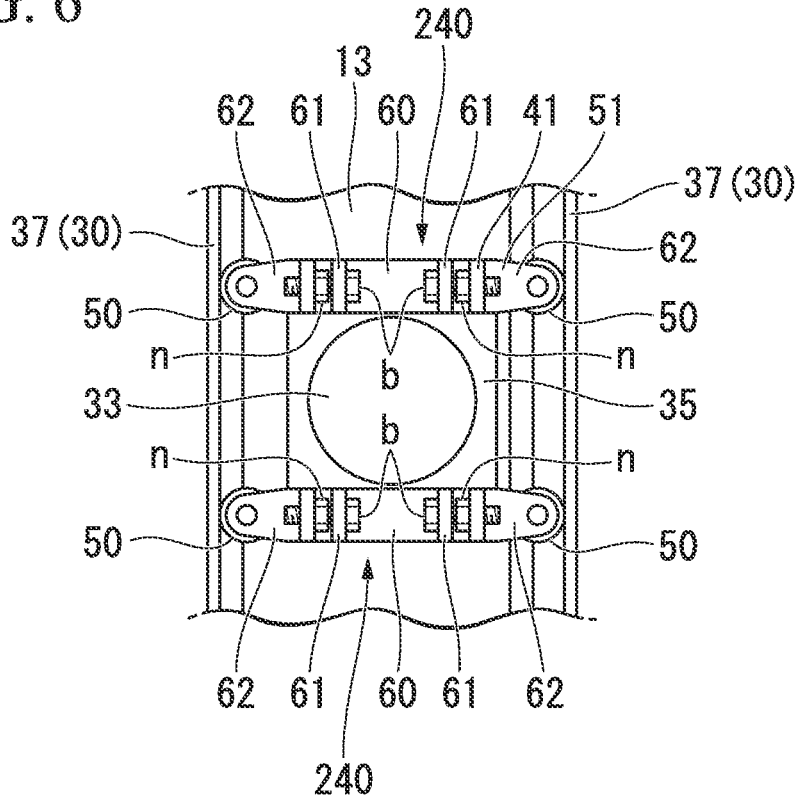
FIG. 6 is a plan view of a position adjusting mechanism of the third embodiment.

As shown in FIGS. 5 and 6, support plates 60 constituting position adjusting mechanisms 240 are mounted on the support portion 35. The support plates 60 are mounted on a front edge portion and a rear edge portion of the support portion 35 so that the longitudinal directions of the support plates are parallel to the width direction of the rail member 13. Furthermore, bolt support portions 61, which protrude upward, are formed on each of the support plates 60 at positions that are symmetrical with each other in the width direction of the rail member 13. Bolts b are rotatably supported by the bolt support portions 61 so as to extend outward in the width direction of the rail member 13. A head portion of each of the bolts B is disposed on the inside of the bolt support portion 61 in the width direction of the rail member 13.

Furthermore, slide members 51 are mounted on both end portions of the support plate 60 in the width direction of the rail member 13. Roller members 50 are rotatably supported on outer portions of the slide members 51. The slide member 51 further includes a nut support portion 41 that is formed by bending an inner portion of the slide member 51 upward in the width direction of the rail member 13. A nut n, which includes a screw hole passing through the nut in an extending direction of the bolt b, is fixed to the nut support portion 41. Further, the above-mentioned bolt b is threadedly engaged with the nut n.

The slide members 51 include horizontal portions 62 extending in the horizontal direction. Lower surfaces of the horizontal portions 62 slide on the upper surfaces of the support plate 60, so that the slide members 51 are allowed to slide in the width direction of the rail member 13. Further, the roller members 50, which are supported by the horizontal portions 62, are adapted to come into contact with the receiving portions 30 that face the roller members 50. Accordingly, when the roller members 50 come into contact with the receiving portions 30, the displacement of the rear traveling mechanism 21 in the width direction of the rail member 13 is regulated.

Furthermore, the slide members 51 are allowed to be displaced in the width direction of the rail member 13 by the rotation of the above-mentioned bolts b. Accordingly, as in the above-mentioned first and second embodiments, it is possible to displace the rear traveling mechanism 21 in the width direction of the rail member 13 when an angular difference is generated between the axis of the bundle 2 and the axis of the casing 3 in plan view. As a result, it is possible to easily insert the bundle 2 into the casing 3 or separate the bundle 2 from the casing 3. Particularly, since the roller members 50 are provided on both sides of the support post 33 in a traveling direction in this third embodiment, it is advantageous in that the total strength of the position adjusting mechanisms 240 mounted on a first rear traveling mechanism 21 can be improved.

Next, a bundle guiding device 100 of a fourth embodiment of the invention will be described with reference to the drawings. Compared to the bundle guiding device 100 of the above-mentioned first embodiment, the bundle guiding device 100 of the fourth embodiment is different only in terms of the structure of a position adjusting mechanism 340. Accordingly, the same portions as portions of the above-mentioned first embodiment will be denoted by the same reference numerals and a repeated description thereof will be omitted here.

Figure 7:
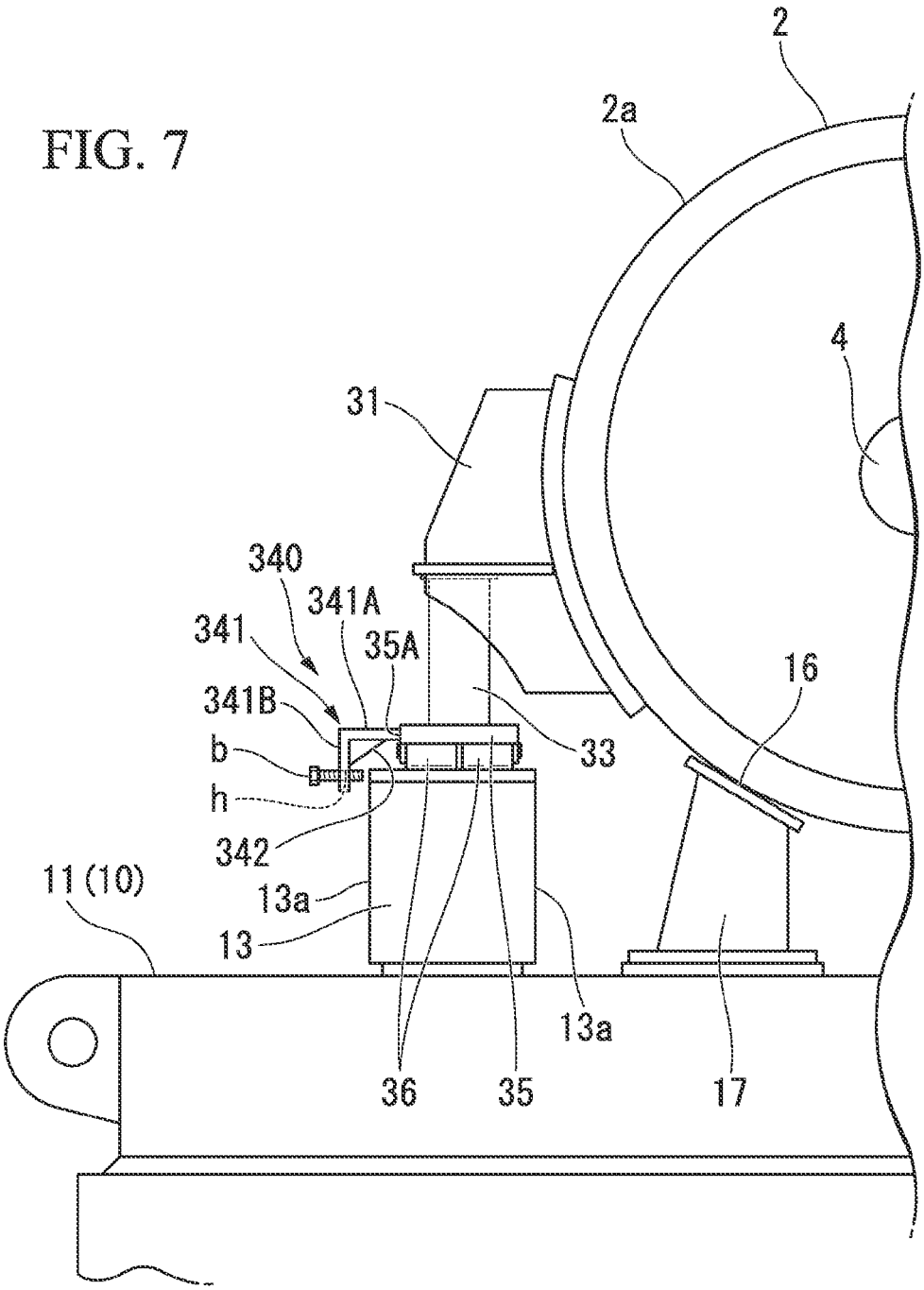
FIG. 7 is a plan view of a position adjusting mechanism of a fourth embodiment.

A position adjusting mechanism 340 adjusts the position of the rear traveling mechanism 21 in the horizontal direction that is orthogonal to the insertion direction of the bundle 2. As shown in FIG. 7, the position adjusting mechanism 340 is provided only on one side of the upper surface of the support portion 35, which constitutes the rear traveling mechanism 21, in the horizontal direction, that is, on the outer side of the support portion 35 in the horizontal direction in this embodiment.

Meanwhile, the rear traveling mechanism 21 is provided with the position adjusting mechanism 340 in this embodiment, but the invention is not limited thereto. When a middle roller is provided in the middle portion of the bundle 2 in the axial direction, that is, at a position between the inner rollers 20 and the outer rollers 36, the position adjusting mechanism 340 may be provided on this middle roller.

The position adjusting mechanism 340 includes a bolt support portion 341 that is fixed to the support portion 35, a bolt b that is supported by the bolt support portion 341, and a reinforcing plate 342 that structurally reinforces the bolt support portion 341.

The bolt support portion 341 is a member having an L-shaped cross section that includes a first flat plate portion 341A and a second flat plate portion 341B orthogonal to each other. A screw hole h is formed in the second flat plate portion 341B so as to pass through the second flat plate portion 341B in a thickness direction thereof, and a thread groove (not shown), which is threadedly engaged with the bolt b, is formed on the inner peripheral surface of the screw hole. An end portion of the first flat plate portion 341A of the bolt support portion 341, which is formed as described above, is fixed to an outer side surface 35A of the support portion 35, so that the first flat plate portion 341A extends in the horizontal direction and the second flat plate portion 341B extends in the vertical direction.

The bolt b includes a shaft portion which includes a thread formed on the outer peripheral surface thereof and a head portion that is formed at one end of the shaft portion. The bolt b is threadedly engaged with the thread groove of the second flat plate portion 341B from the outside of the track, so that the shaft portion extends in the horizontal direction. Further, it is possible to adjust the length of the shaft portion, which protrudes toward the inside of the track from the second flat plate portion 341B, by rotating the bolt b in a normal direction or a reverse direction.

Next, a procedure for inserting the bundle 2 into the casing 3 by using the bundle guiding device 100 of the fourth embodiment will be described.

First, the rear end portion of the bundle 2 is placed on the rail members 13 through the rear traveling mechanisms 21. Further, at this time, the inner rollers 20, which are provided at the front portion of the bundle 2, are placed on the inner rail members 17.

After that, the end of the shaft portion of the bolt b is separated from the rail member 13 by the rotation of the bolt b of the position adjusting mechanism 340. In this state, the bundle 2 is pressed toward the casing 3 by the hydraulic cylinder 22. Accordingly, the inner rollers 20 roll on the inner rail members 17 and the outer rollers 36 roll on the rail members 13, so that the bundle 2 moves toward the casing 3 in the axial direction. Furthermore, when the foremost portion of the bundle 2 in the insertion direction reaches a position just before the opening 5 of the casing 3, the movement of the bundle 2 is stopped.

After that, a positional relationship between the axis of the bundle 2 and the axis of the casing 3 is measured. As a result, when an angular difference is generated between the axis of the bundle 2 and the axis of the casing 3 in plan view, the outer side surface of the rail member 13 is pressed by the end of the shaft portion of the bolt b through the rotation of the bolt b of the position adjusting mechanism 340 provided at the foremost portion of the bundle 2 in the insertion direction. As a result, a horizontal adjusting force is applied to the rail member 13. The positions of the outer rollers 36 on the rail member 13 in the width direction are adjusted in this way, so that the axis of the bundle 2 corresponds to the axis of the casing 3.

Then, the end of the shaft portion of the bolt b is separated from the rail member 13 again by the rotation of the bolt b of the position adjusting mechanism 340. In this state, the bundle 2 is pressed toward the casing 3 by the hydraulic cylinder 22. Since the inner rollers 20 move toward the inner peripheral surface 3*a* of the casing 3 from the inner rail members 17 in this case, the bundle 2 is inserted into the casing 3 from the foremost portion thereof in the insertion direction.

After that, when an angular difference is generated between the axis of the bundle 2 and the axis of the casing 3 in plan view during the movement of the bundle 2, as described above, an adjusting force is applied to the rail member 13 in the horizontal direction by the rotation of the bolt b of the position adjusting mechanism 340 that is provided on the rear portion of the bundle 2 in the insertion direction. As a result, the axis of the bundle 2 corresponds to the axis of the casing 3.

Then, when the bundle 2 has been completely received in the casing 3, the rear traveling mechanisms 21 are removed from the bundle 2 and a series of the above-mentioned work for inserting the bundle 2 into the casing 3 ends.

According to the procedure for inserting the bundle 2 into the casing 3 by using the bundle guiding device 100 of the fourth embodiment as described above, work for making the axis of the bundle 2 correspond to the axis of the casing 3 is performed during stoppage of the bundle 2, and the end of the shaft portion of the bolt b is separated from the rail member 13 during movement of the bundle 2. Accordingly, the bundle 2 can be accurately and smoothly moved without being affected by a dimension error or a mounting error of the rail member 13 or the roller member 50 and a frictional force between the bolt b and the rail member 13.

The invention is not limited to the structures of the above-mentioned respective embodiments, and may have design modifications without departing from the scope of the invention.

For example, the bolts b of the first embodiment and the roller members 50 of the second embodiment, which have been described above, may be provided on both sides in the traveling direction with the support post 33 interposed therebetween as in the third embodiment.

Further, a case in which the roller member 50 is made of metal has been described in the above-mentioned second and third embodiments. However, as long as the roller member 50 is hardly elastically deformed, the material of the roller member 50 is not limited to metal.

Moreover, a case in which the rail members 13 for traveling support of the receiving portions 30 has been described by way of example in the above-mentioned respective embodiments, but the base surface 11 of the frame 10 may support the receiving portions 30. Further, cases in which the rear traveling mechanism 21 of the bundle 2 is provided with the position adjusting mechanisms 40, 140, 240, and 340 have been described, but the rear traveling mechanism 21 may be provided with the receiving portions 30 and the base surface 11 or the rail member 13 may be provided with the position adjusting mechanism 40, 140, 240, or 340. In this case, the base surface 11 or the rail member 13 may be provided with a plurality of position adjusting mechanisms 40, 140, 240, and 340 in the insertion direction of the bundle 2.

Furthermore, cases in which the position of the rear portion of the bundle 2 is adjusted in the horizontal direction orthogonal to the insertion direction by using the bolts b in the position adjusting mechanisms 40, 140, 240, and 340 of the above-mentioned respective embodiments have been described. However, the position of the rear portion of the bundle may be adjusted using a hydraulic cylinder, an electric actuator, or the like. Moreover, a sensor, which detects the position of the axis of the bundle 2 relative to the axis of the casing 3, may be provided and the hydraulic cylinder, the electric actuator, or the like may be driven on the basis of a detection result of the sensor to automatically adjust the position of the rear traveling mechanism 21 of the bundle 2 so that an angular difference between the axis of the casing 3 and the axis of the bundle 2 is eliminated.

Further, cases in which the receiving portion 30 forms a vertical surface have been described in the above-mentioned respective embodiments. However, as long as a horizontal adjusting force can be applied to the receiving portion, the receiving portion 30 is not limited to a vertical surface and may be an inclined surface.

INDUSTRIAL APPLICABILITY

The invention relates to a bundle guiding device of a compressor configured to guide a bundle into a casing and a bundle guiding method of a compressor by which a bundle is guided into a casing.

According to the invention, it is possible to reduce the burden of a worker by reducing the time required to perform work which allows the bundle to be received in the casing.

REFERENCE SIGNS LIST

3: casing
4: rotor
11: base surface
13: rail member
20: inner roller
30: receiving portion
36: outer roller
40, 140, 240, 340: position adjusting mechanism
50: roller member (roller)
C: stationary part

The invention claimed is:

1. A bundle guiding device of a compressor in which a bundle is to be inserted to a casing, the bundle including a rotor and a stationary part by which the rotor is rotatably supported, the bundle guiding device comprising:

an inner roller that is mounted on a front portion of the bundle in an insertion direction of the bundle and is configured to roll in the insertion direction on an inner peripheral surface of the casing;

an outer roller that is mounted on a rear portion of the bundle in the insertion direction of the bundle and is configured to travel on a rail member fixed onto a base surface on which the casing is disposed;

a position adjusting mechanism that is configured to adjust a position of the bundle in a horizontal direction orthogonal to the insertion direction by applying an adjusting force to a receiving portion in the horizontal direction, wherein either the position adjusting mechanism or the receiving portion is on the bundle, wherein either the position adjusting mechanism or the receiving portion which is not on the bundle is on one of the base surface and the rail member, and wherein the rail member is one of a first pair of rail members, and a second pair of rail members extends inside a track of the first pair of rail members.

2. The bundle guiding device of a compressor according to claim 1, wherein the position adjusting mechanism includes a metal roller configured to roll in the insertion direction while in contact with the receiving portion.

3. The bundle guiding device of a compressor according to claim 1, wherein the rail member extends in an axial direction of the bundle.

4. The bundle guiding device of a compressor according to claim 1, wherein a majority of the rail member is outside the casing.

5. The bundle guiding device of a compressor according to claim 1, wherein the second pair of rail members includes inclined surfaces.

6. The bundle guiding device of a compressor according to claim 1, further comprising a rear traveling mechanism which is mounted on the bundle and is configured to travel on the rail member.

7. The bundle guiding device of a compressor according to claim 6, wherein the rear traveling mechanism includes a bracket, a support post, a support portion, and the outer roller.

8. The bundle guiding device of a compressor according to claim 1, further comprising a first angle steel fixed to the rail member.

9. The bundle guiding device of a compressor according to claim 8, wherein the first angle steel has an L-shaped cross section.

10. The bundle guiding device of a compressor according to claim 8, further comprising a second angle steel fixed to the first angle steel.

* * * * *